US009700125B2

(12) United States Patent
Leslie

(10) Patent No.: US 9,700,125 B2
(45) Date of Patent: Jul. 11, 2017

(54) RETAINER ASSEMBLY HAVING A ROTATABLE, RELEASABLE SNAP BUTTON ENGAGEMENT

(71) Applicant: Henry E. Leslie, San Antonio, TX (US)

(72) Inventor: Henry E. Leslie, San Antonio, TX (US)

( * ) Notice: Subject to any disclaimer, the term of this patent is extended or adjusted under 35 U.S.C. 154(b) by 82 days.

(21) Appl. No.: 14/445,791

(22) Filed: Jul. 29, 2014

(65) Prior Publication Data

US 2015/0033506 A1 Feb. 5, 2015

Related U.S. Application Data

(60) Provisional application No. 61/861,503, filed on Aug. 2, 2013.

(51) Int. Cl.
*A44B 17/00* (2006.01)
*A45F 5/00* (2006.01)
(Continued)

(52) U.S. Cl.
CPC ..... *A45F 5/00* (2013.01); *A45F 3/14* (2013.01); *A44B 17/0041* (2013.01); *A45F 2003/142* (2013.01); *A45F 2005/006* (2013.01); *A62B 18/084* (2013.01); *Y10T 24/1374* (2015.01); *Y10T 24/47* (2015.01)

(58) Field of Classification Search
CPC ..... Y10T 24/47; Y10T 24/45461; Y10T 24/1374; A45F 2005/008; A45F 2005/006; A45F 5/00; A45F 3/14; A45F 2003/142; A44B 17/0041; A62B 18/084
See application file for complete search history.

(56) References Cited

U.S. PATENT DOCUMENTS 2,819,650 A * 1/1958 Seron ..... G02C 3/003 2/323
3,392,729 A * 7/1968 Lenoir ..... A61J 17/00 24/3.13

(Continued)

*Primary Examiner* — Robert J Sandy
*Assistant Examiner* — Michael Lee
(74) *Attorney, Agent, or Firm* — Jackson Walker, LLP

(57) ABSTRACT

An assembly is disclosed, the assembly for providing release structure to a lanyard or strap adapted to be worn on the body, such as a neck strap. The release structure consists of a snap button assembly configured such that the release pull generated by tension in the strap is directed along an axis perpendicular to the closure and rotation plane of the male and female portion of the snap button assemblies. With structure to configure a release pull in such an axis, a safety feature is provided to the wearer such that tension in the strap, when it reaches a sufficient force to overcome the closure forces of the snap button assembly, will release the closed snap button and allow the strap to fall away from the body. Also, as in the case of a firefighter wearing an SCBA fire mask, it prevents the firefighter from being entangled or tethered if the strap were to get accidentally hooked or caught on something. The breakaway will allow the firefighter to continue using the mask with no interruption of breathing air from the mask. In lanyards and tool holders, those fall away from the body. In the case of a firefighter, the mask does not fall away from the body.

21 Claims, 15 Drawing Sheets

(51) Int. Cl.
*A45F 3/14* (2006.01)
*A62B 18/08* (2006.01)

(56) References Cited

U.S. PATENT DOCUMENTS

| | | | | | |
|---|---|---|---|---|---|
| 4,136,934 | A * | 1/1979 | Seron | G02C 3/003 | 24/3.3 |
| 4,304,403 | A * | 12/1981 | Wilson | A63B 67/00 | 24/310 |
| 6,725,506 | B1 * | 4/2004 | Anscher | A44B 99/00 | 24/170 |
| 2002/0069451 | A1 * | 6/2002 | Yamaguchi | A45C 7/0059 | 2/338 |
| 2003/0033697 | A1 * | 2/2003 | Hicks | A44B 11/006 | 24/615 |
| 2004/0134039 | A1 * | 7/2004 | Tracy | A44B 99/00 | 24/3.4 |

* cited by examiner

10 -

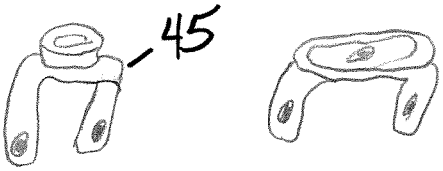
Fig. 15
Fig. 17
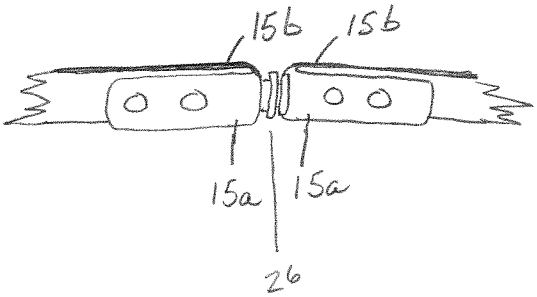
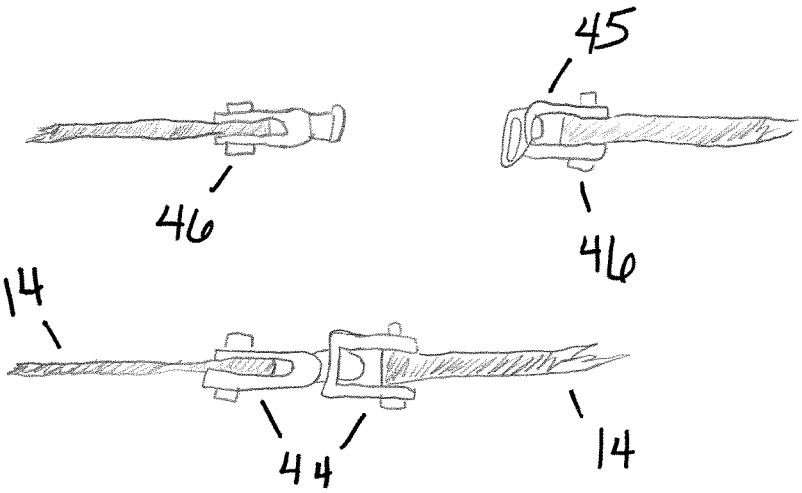
Fig. 16

RETAINER ASSEMBLY HAVING A ROTATABLE, RELEASABLE SNAP BUTTON ENGAGEMENT

This application claims the benefit of and incorporates herein by reference U.S. Provisional Patent Application Ser. No. 61/861,503 filed Aug. 2, 2013.

FIELD OF THE INVENTION

Retainer assemblies, including neck straps with separable elements for holding a workpiece.

BACKGROUND OF THE INVENTION

Neck straps are linear, flexible fabric elements adapted to be received around the neck of a wearer and for holding or retaining on the neck of the wearer, any number of various workpieces or items, including: firefighter's breathing air masks, eyeglasses, respirators, face gear, head gear, lanyards, and other suitable items.

Oft-times, neck straps need to merely releasably engage the workpiece, such as by snap clips or threadable rings and loops. The retainment of a workpiece by a neck strap is often fairly straightforward. A strap or linear element may be passive, such as straps for connecting the removed end of eyeglasses when the eyeglasses are being worn, or they may be active (that is, supporting the weight of the workpiece), such as when the eyeglasses are removed and being actively maintained on the wearer by the neck strap.

There are cases, however, when either convenience or, more importantly, safety dictates a rapid, safe, easy release of one element of the neck strap from another.

One such "quick release" scenario is played out in FIGS. 6A, 6B, 6C, and 6D. The inventor of the instant devices is a professional firefighter with several decades experience. He is seen here wearing a fire mask, which has a neck strap, including elements of embodiments of the invention as set forth herein. The firefighter merely needs to grasp a portion, if time permits, or just pull away with minimal force, the strap is designed to breakaway automatically with minimal force (linear pull) without the use of the firefighters' hands.

In the action sequence 6A-6D, a simulated event is shown, which depicts actual events that have occurred in emergency situations involving firefighters. Here, through a sequence of four photographs, a neck strap which engages the firefighter's mask and hangs loosely around the neck, is accidentally caught on a door handle. Imagine that the scene is smoky and visibility is low. With prior art snap clips or fastening elements, the firefighter ends up fumbling around trying to remove a neck strap that is caught on something (here, a door handle) while a fire rages around him. With the embodiment of Applicant's novel device set forth herein, the firefighter merely needs to grasp a portion of the neck strap and yank or just pull away forcing strap to break away.

When a firefighter's hands are busy holding equipment or tools or a rescued victim, there is no time to stop and pull on a caught strap. The Applicant's strap disengages itself ("hands free"—the firefighter does nothing) from the entanglement dilemma ("Life Safety"), because of the linear pull design. With as little as about 7 lbs. of pressure, the strap with snap buttons disengage with no damage to the expensive SCBA mask.

There are a number of other embodiments of Applicant's novel neck strap and neck assembly. In most embodiments, a snap button or equivalent device is used to engage either the neck strap to a workpiece or one portion of the neck strap to another portion of the neck strap. Moreover, the snap button used is configured on the strap or strap elements, such that the pull separation or force is substantially perpendicular to the plane of the closure elements of the snap. Thus, in embodiments of Applicant's neck strap and neck strap assembly, cooperating male and female elements of a snap button are affixed to a strap, which when pulled applies a force about an axis perpendicular to the face of the closure elements of the snap button or other snap. The breakaway snap button can also be located on any part of the neck strap for safety purposes.

SUMMARY OF THE INVENTION

Applicant provides a retainer assembly comprising, in one embodiment, a workpiece that may include a firefighter's mask. A neck strap is typically provided with a first and second end, the first and second ends adapted to be releasably engaged to the workpiece, as by clips or other conventional elements. The neck strap includes at least one snap button assembly, the snap button assembly having a female portion and a male portion. The two snap button portions are releasably engageable and rotatable, in that they have closure elements which releasably engage one another and which lay when engaged in a closure plane. The strap portions of the neck strap engage each of the snap button portions, such that applying tension to the strap aligns the strap portion with the axis of rotation of the closure plane.

The snap buttons can also be a plastic snap button breakaway; KAM® buttons, and made of plastic where melting is not a concern. At a workplace, an I.D. lanyard or a swipe card can have this type of breakaway at a location right above the I.D. or swipe card, and at another portion of the neck strap, preferably the center, for safety reasons. If the I.D. or swipe card gets caught on a piece of machinery or moving parts, the I.D. will breakaway at a safe amount of pressure. If the I.D. or swipe card was to get caught at a point where even the breakaway gets caught, the centrally located breakway (or at any other part of the lanyard), will offer (provide) yet another point of automatic safety release, preventing injury to the wearer.

It is very new, different, and useful in the fire industry, but can be used in many other industries where a neck or wrist strap is necessary or desired (work, sport, leisure, hobby).

An assembly for releasably retaining a workpiece to a person's body comprising a lanyard or neck strap having a first and a second end, the ends for engaging the workpiece, and a body portion between the two ends of the strap, a snap button assembly comprising a circular male portion and a circular female portion, the two portions lay in a common plane when releasably joined and are rotatable, one with respect to the other, about a common axis of rotation; and means for engaging the male portion and the female portion to the strap or the workpiece to translate tension in the neck strap to a separation force that is along the same axis as the axis of rotation. The means for engaging may comprise on one or both of the male and female portions, a pair of short strap sections forming a V-shape, with the mouth of the "V" spanning the male and/or female portion, and the apex of the "V" joining the strap or the workpiece. The means for engaging may be a D-ring with a curved portion and a straight member, the straight member attached to the female or the male portion, or each portion, of the snap button assembly.

The assembly may include a snap or spring clip for engaging the D-ring to the workpiece. The D-ring may further include a transverse bar for receiving a portion of the strap. The means for engaging may include a rigid U-shaped member; wherein the legs of the U-shaped member engage the body of the strap and the base engages one or both of the male/female portions; wherein the legs of the U-shaped member include a cross-bar therebetween for engagement with the strap; wherein the body of the strap has a width and wherein the length of the cross-bar is about equal to the width of the strap.

BRIEF DESCRIPTION OF THE DRAWINGS

FIG. 1A is a perspective view of a multiplicity of different embodiments of releasable, rotatable snap buttons.

FIGS. 9-17 illustrate additional embodiments of Applicant's snap button assemblies.

DETAILED DESCRIPTION OF THE PREFERRED EMBODIMENTS

Figure 1:
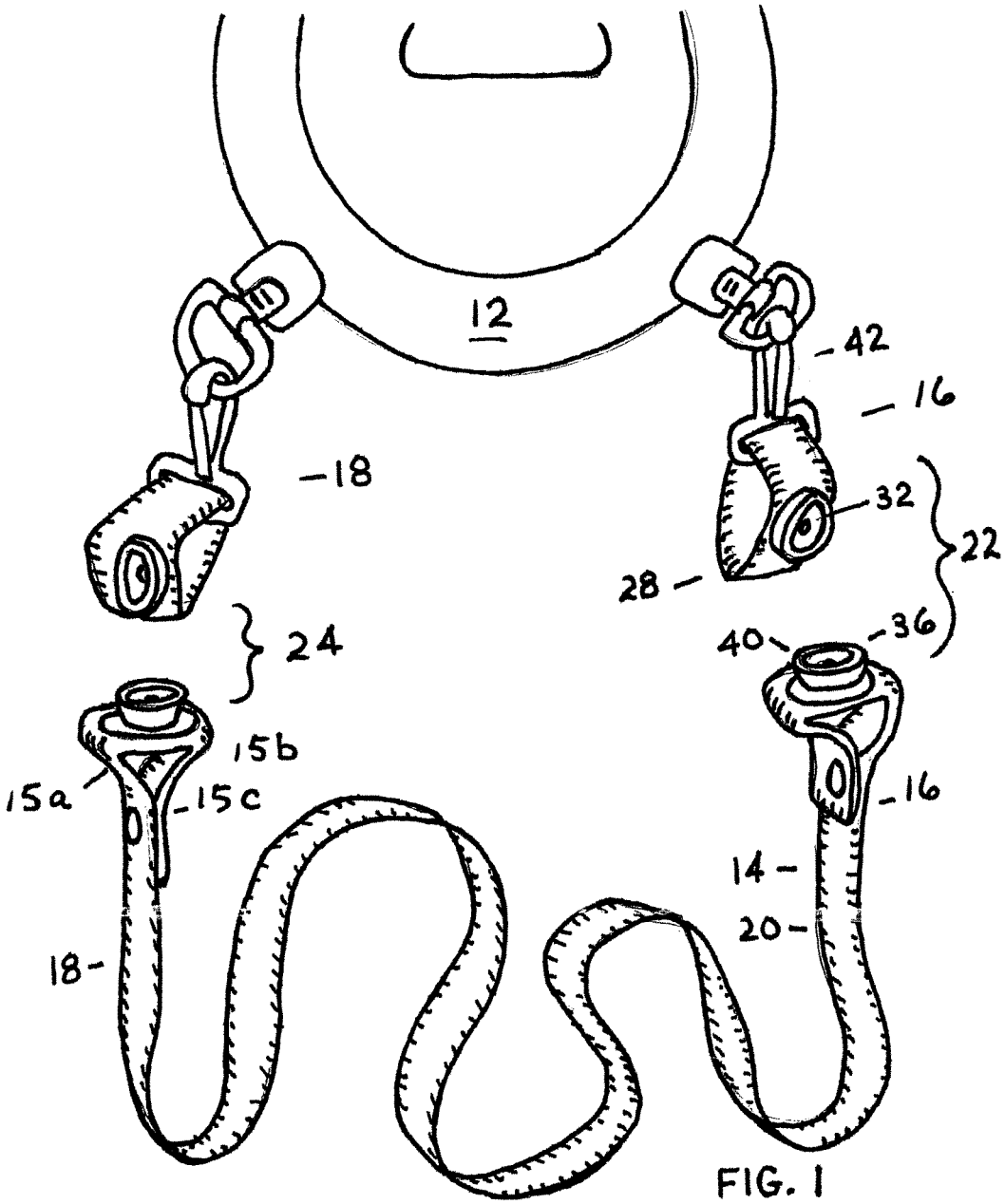
FIG. 1 is a perspective illustration of an embodiment of Applicant's retainer assembly.

FIGS. 1-5 illustrate some of the details of Applicant's preferred embodiments of a retainer assembly 10. It is noted that retainer assembly 10 typically comprises a neck strap 14, which may be a flexible linear element often made of a fabric, neck strap 14 having a first end 16 and a second end 18, and a body 20 therebetween. First end 16 or second end 18 are typically attached to a workpiece 12, which in the illustrations is a firefighter's SCBA air mask. However, workpiece 12 may include any element that typically carries a neck (or other strap that engages the body) strap 14, such as: lanyards in the workplace, eyeglasses, eye protection, face protection (face shield), tool holders, head gear, and head protection (helmet). First end 16 and second end 18 may be adapted, as with snap clips 42 or the like to attach, in one case removably, to elements, here, D-rings or clips of the workpiece. The snap clips 42 that are attached to the D-rings of the workpiece may also engage the fabric (strap material being of desired fabric/material for particular field/industry, e.g., the strap may be made of leather or fireproof Kevlar® in the firefighting industry) or other material of neck strap 14, either fixedly or adjustably.

It is seen that near either end of neck strap 14 or any place along the body may be one or more rotatable release snap button assemblies, here, designated 22/24 (either end)/26 (in the body, see FIG. 17). In one embodiment (see FIGS. 2 and 5, for example), the snap button assemblies are found at or near either or both ends of neck strap 14, where the neck strap 14 is engaged to a workpiece. In another embodiment, one or more snap button assemblies are located anywhere along the linear elements of the body of neck strap 14. In another embodiment, an assembly is located near the center of the neck strap 14.

The Figures, including FIG. 1A, illustrate the various types of rotatable, release snap button assemblies that may be used in Applicant's neck strap 14 for releasably engaging one section of the strap or workpiece Wp with another in a manner that will allow the strap to be quickly and easily separated, and in a manner in which one portion of the strap and the other portion of the strap, which are engaged by a snap button assembly, may rotate one with respect to the other.

First, a look at the details of Applicant's snap button assemblies. There is seen to include a female portion 28, which typically has at least an outer surface 30, recessed portion 32, and resilient or spring-like elements 34 (which may be a cylindrical loop) for engagement with an extending rim 40 of male portion 36. In one embodiment, male portion 36 is seen also to include an outer surface 38. In typical snap button assemblies, outer surface 30 is press fit and configured into recessed portion 32 and outer surface 38 is press fit to extending rim 40 of male portion.

While Applicant's neck strap may indeed press the two joining elements over fabric so as to lock the fabric to both a female portion 28 and male portion 36, a difference in Applicant's application lies in which the neck strap and snap button assemblies are engaged to the workpiece or strap. It will be seen that when the closure elements (male extending rim 40 into female recess portion 32) are joined, they lay in a plane in which one can rotatably move with respect to the other about a common rotation axis. What Applicant does is provide means 60 to place a pull line along the neck straps (or workpiece and neck strap) of each of the male and female portions, such that they pull along the rotatable axis so as to provide a force normal to separate the male portion from the female portion. That is, the separation forces are adapted to align along the neck strap when it is pulled in a linear fashion in a manner that is perpendicular to the closure plane or the plane in which the two portions rotate, and along the axis of rotation with respect to the snaps. The axis of rotation is seen to be coming out of the page and into the page in FIG. 1A.

Figure 2:
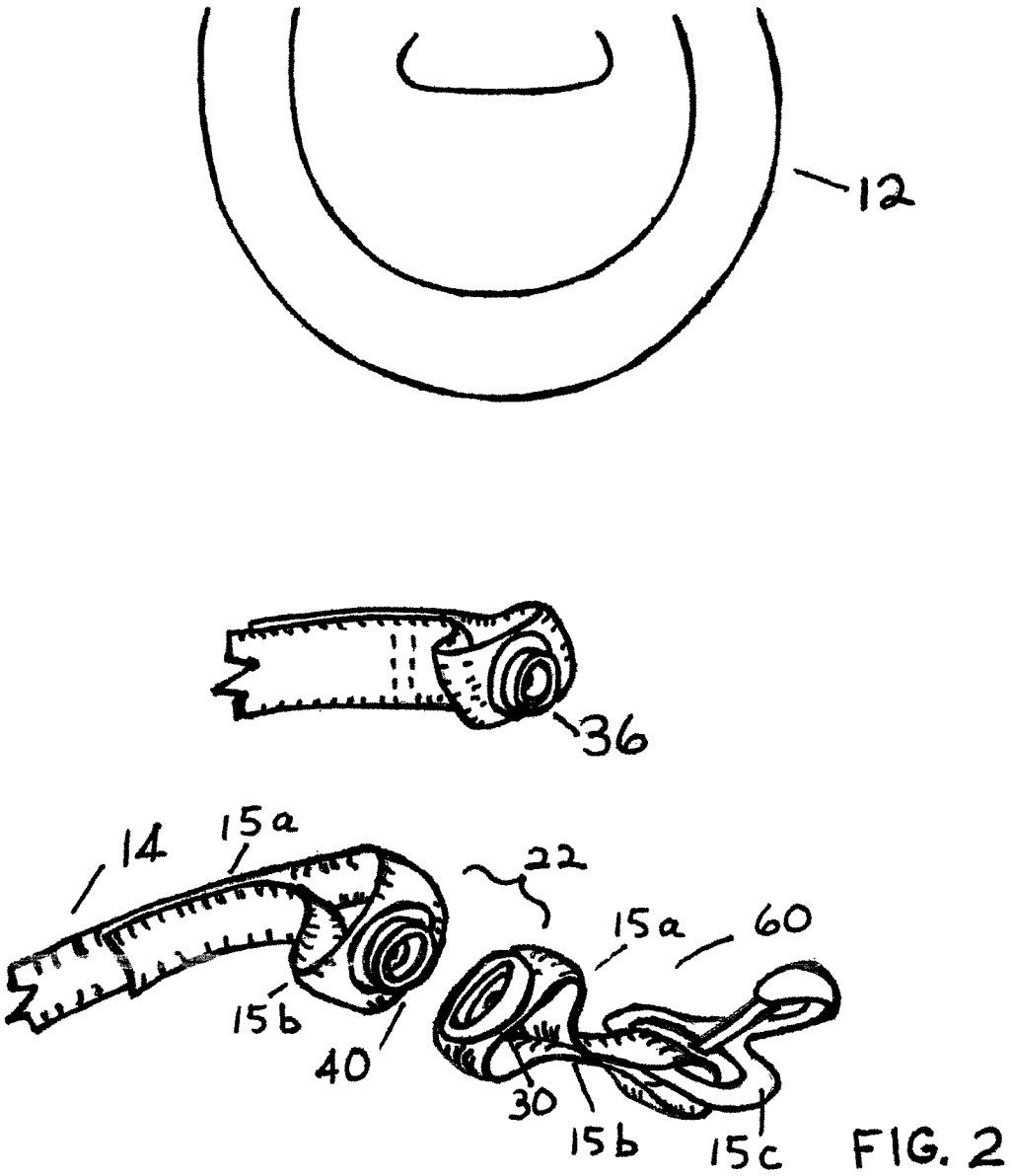
FIG. 2 is a perspective illustration showing a snap button assembly with the male and female portions detached from one another in a manner in which the flexible straps engage the snap button portion, so that the pull is linearly along the rotatable axis of the snap button.
Figure 3:
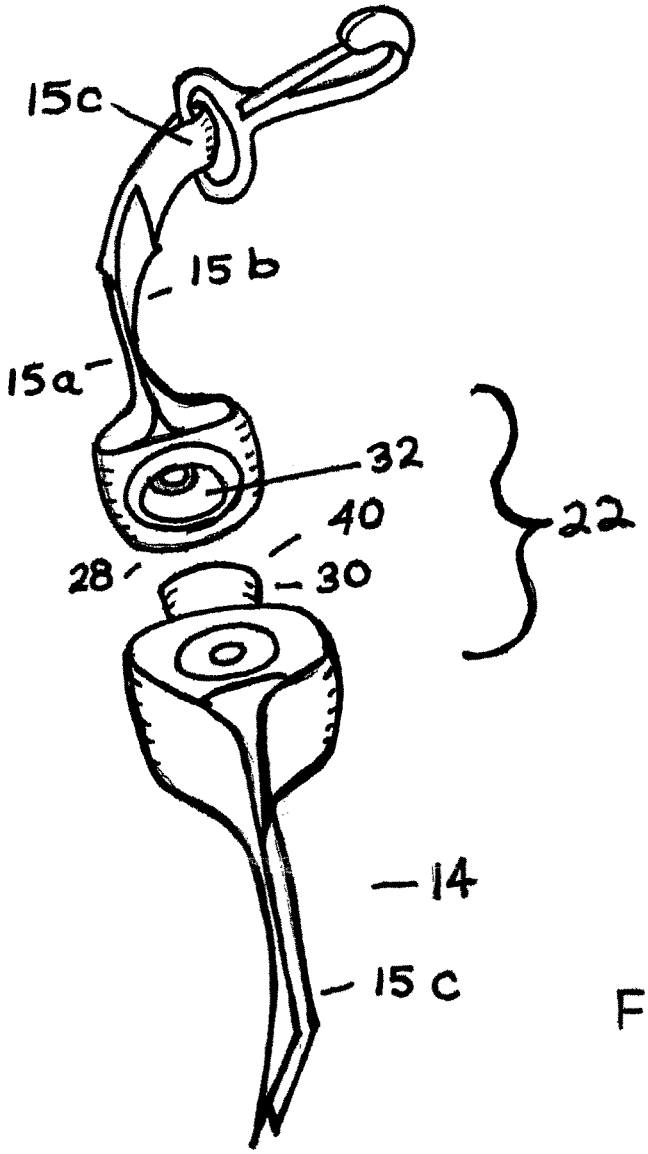
FIG. 3 is another perspective photographic view of the snap button assembly with the male and female portions separated.
Figure 4:
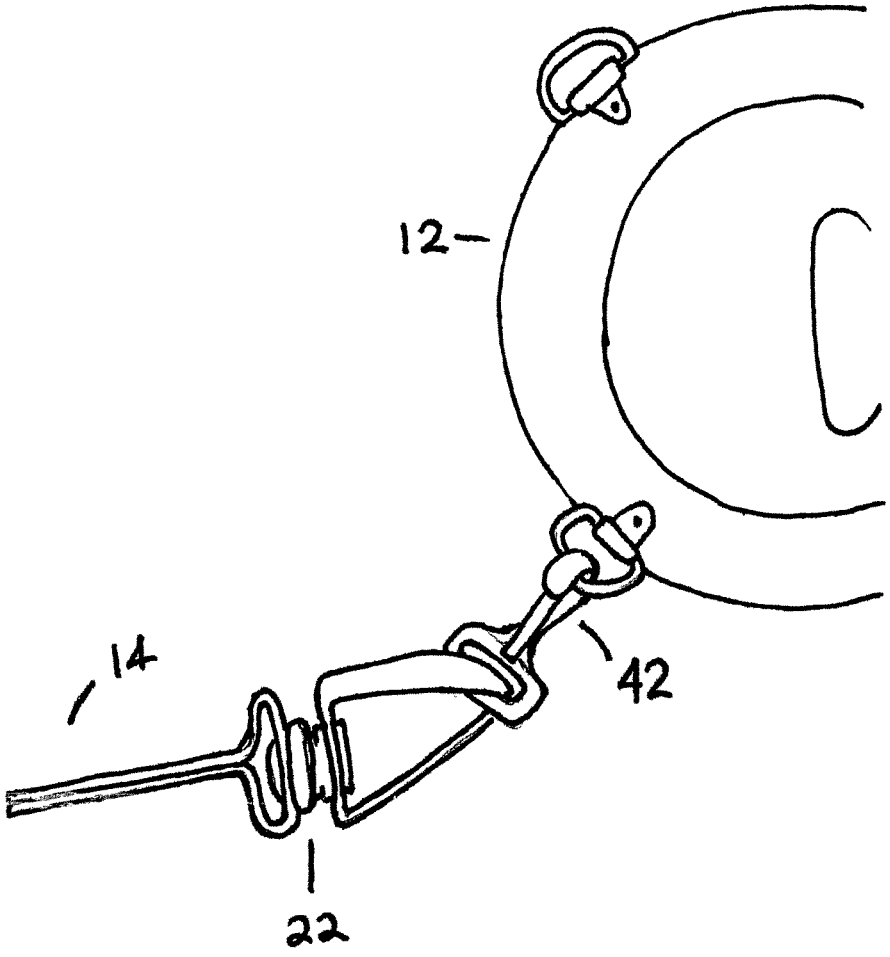
FIG. 4 is another perspective view of the snap button assembly in Applicant's embodiment showing the male and female portions of the snap button engaged to one another and showing the manner in which the straps attach to the snap button portions, so the pull separating the snap button is linear along the axis of rotation of the snap button assembly.
Figure 5:
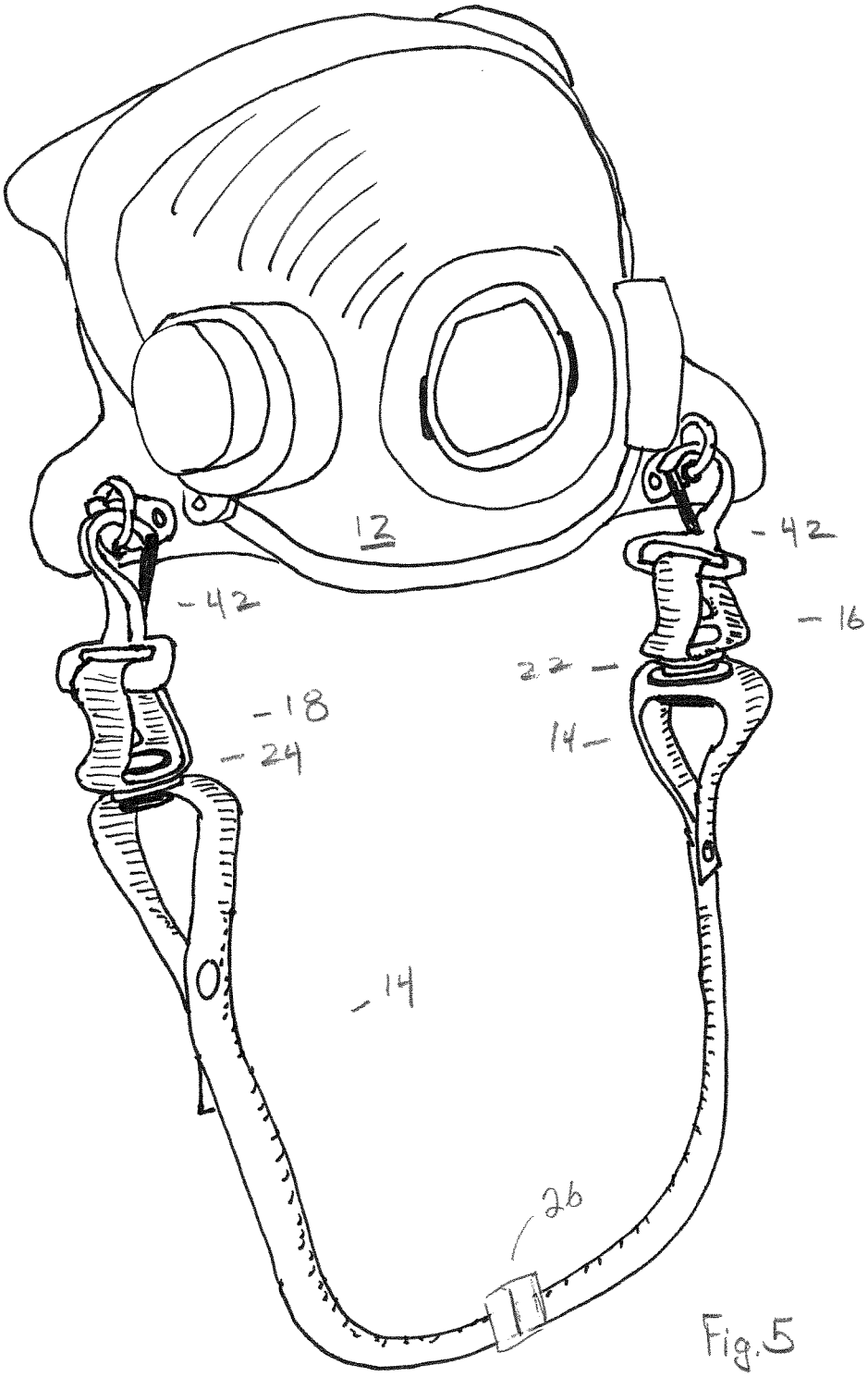
FIG. 5 shows a pair of snap button assemblies in perspective used to engage a strap to a workpiece, here, a firefighter's mask.
Figure 6A:
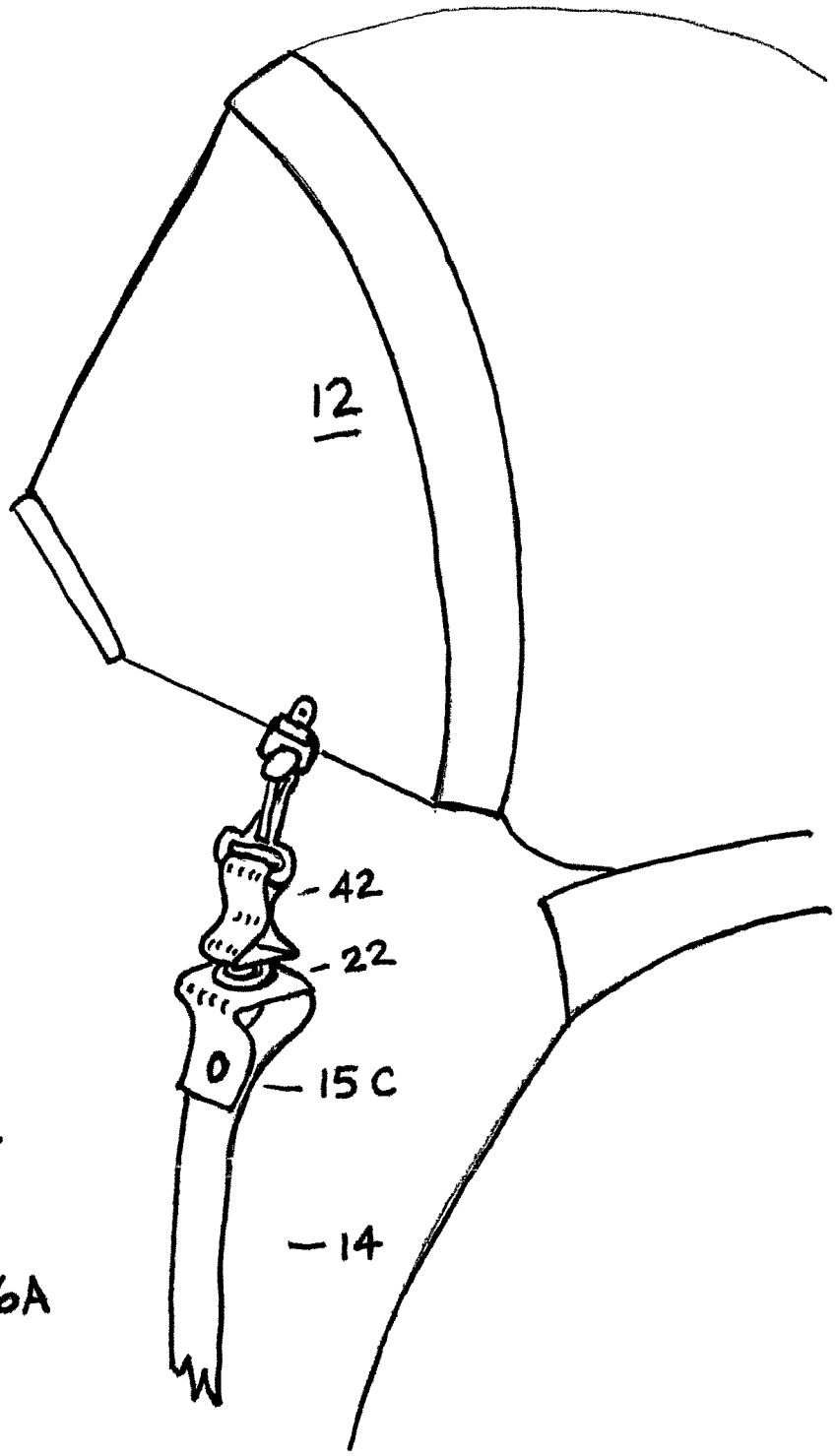
FIGS. 6A, 6B, 6C, and 6D are simulated action shots of a firefighter's mask as a workpiece and part of Applicant's retainer assembly using Applicant's novel snap assemblies.
Figure 6B:
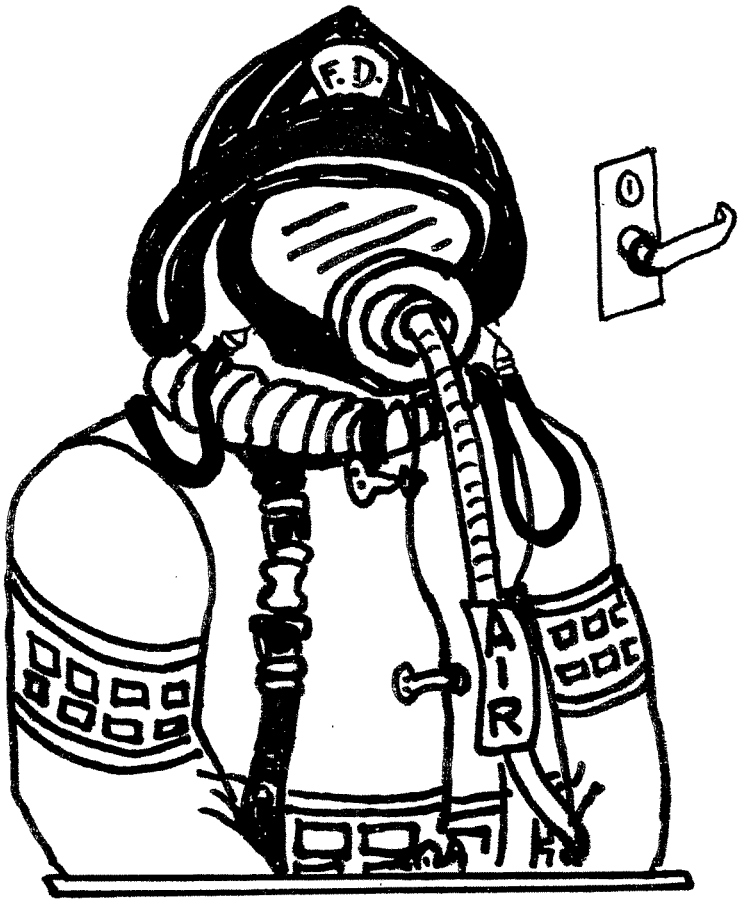
Figure 6C:
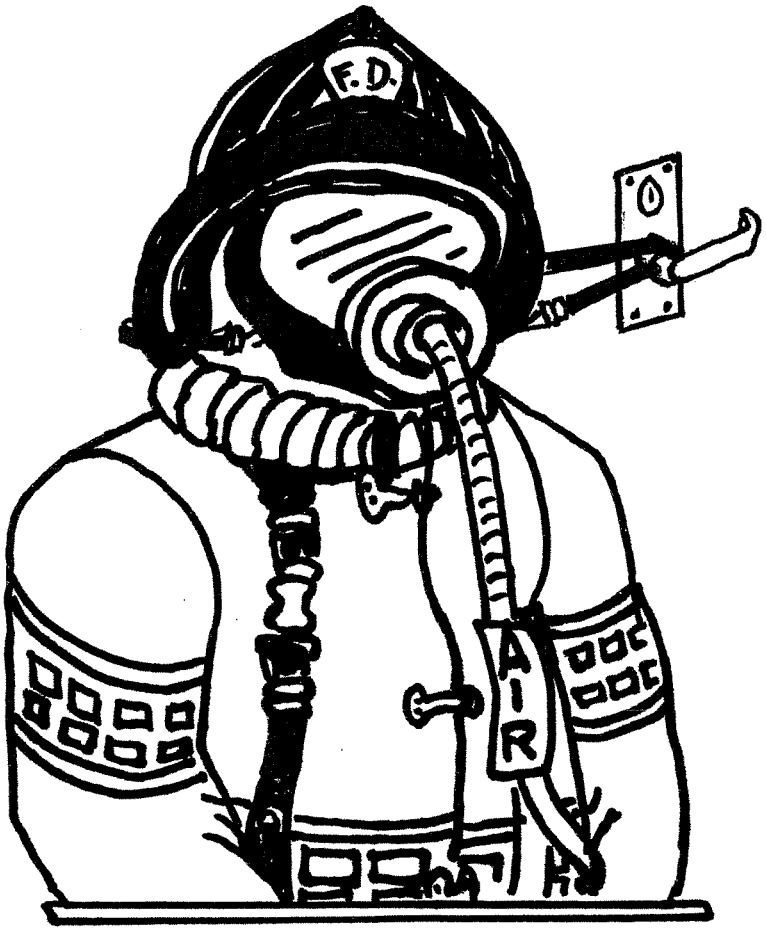
Figure 6D:
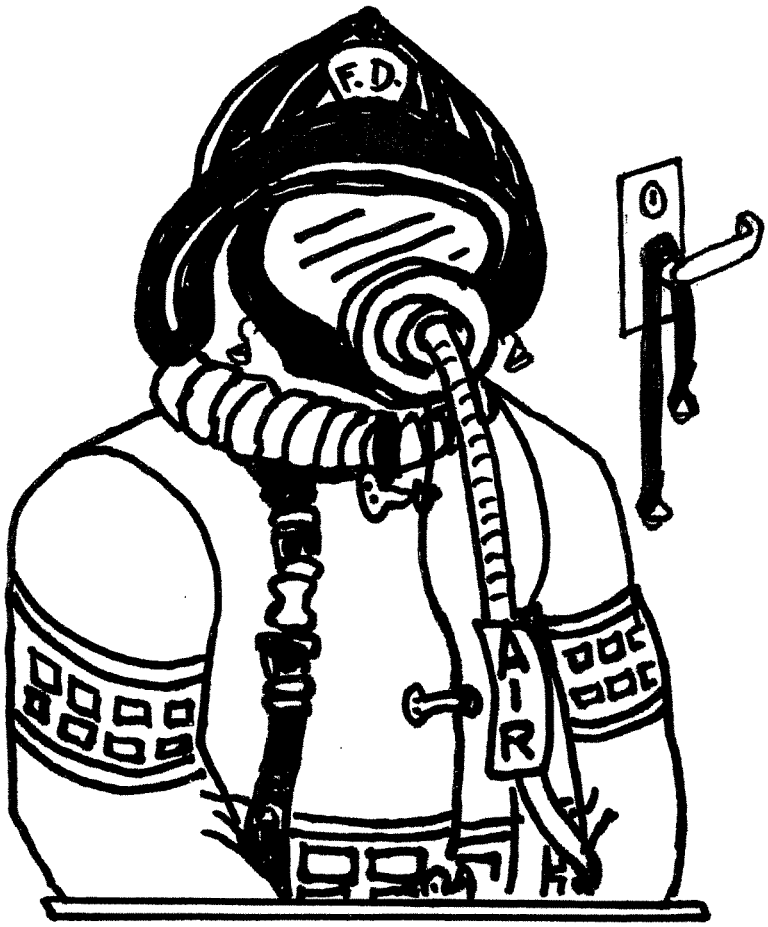
Figure 7:
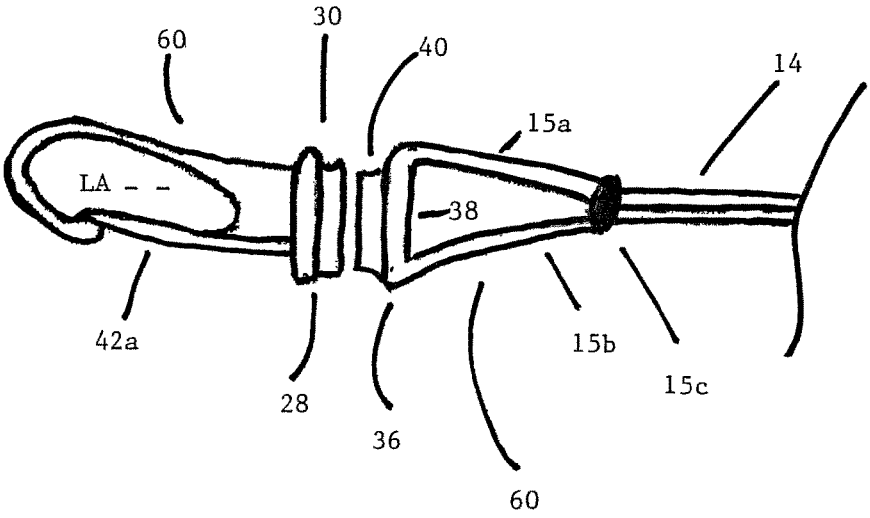
FIG. 7 is a perspective view of one embodiment of Applicant's novel snap button assembly.

As seen in FIGS. 2 and 7, two V-shaped sections of the strap 15*a*/15*b* extending out from the clamp portions are folded back and are engaged one to the neck strap 15*c*, so that each of the two extension portions are about equidistant from the male or female portion. This tends to settle releasing forces either along the axis of separation or around the circumference of the round elements of the two portions of the snap, so that they translate into separation forces perpendicular to the closure plane. This differs from the typical manner of application of separation force to snap buttons, which is to leverage them apart and pivot them on a torque moment about an axis along the rim.

The manner in which two portions of the neck strap may be folded about the two portions may be seen in FIG. 7, which shows portions 15*a* and 15*b* being attached at 15*c* to neck strap 14. The same may be done for the female portions in the earlier embodiments, for example, see FIG. 5. However, FIG. 7 shows something else, and that is the manner in which alternate embodiments of means 60 may be adapted with structure that achieves the aligned pull of separation of the earlier embodiments. For example, FIG. 7 shows that the female portion 28 is modified, so that extending substantially perpendicular to the plane therefrom, is a modified spring clip 42*a*, modified so that its longitudinal axis is adapted to be perpendicular to the engagement plane, that is, the plane in which the two elements may rotate one with respect to the other when they are engaged.

Figure 8:
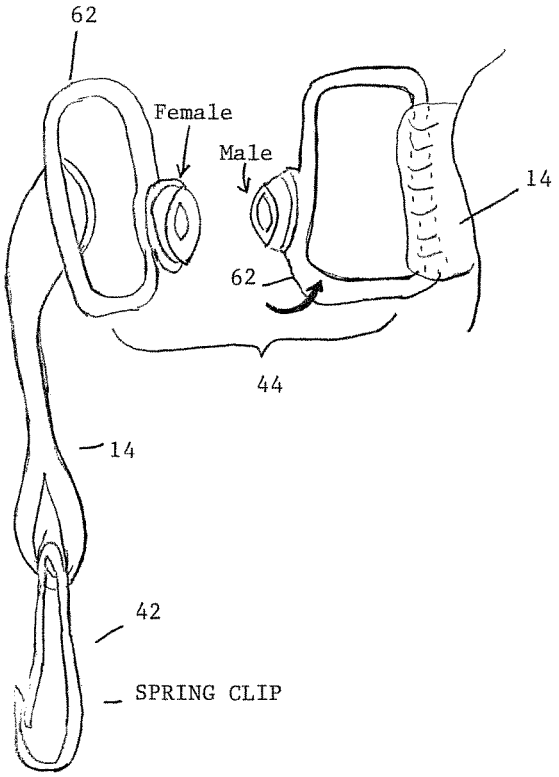
FIG. 8 is a perspective view of yet another embodiment of Applicant's snap button assembly.

FIG. 8 shows means 60 to be a snap button assembly having one or both of the male and female portions engaged to a D-ring or loop 62 configured to attach to a neck strap or workpiece. It will be noted that you still have the axial pull and the rotatable functions, such that rotation is along the pull axis when the neck strap is drawn tight. Spring clip 42 is used in FIG. 8 to attach neck strap 14 to a workpiece.

Figure 8A:
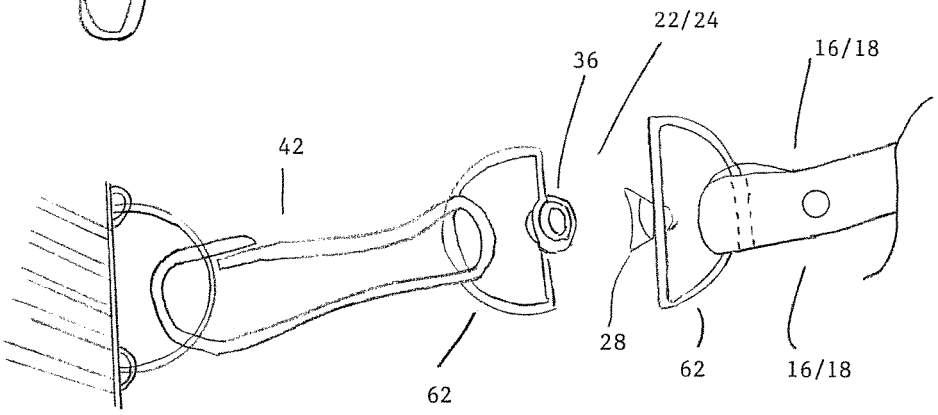
FIG. 8A is a perspective view of another embodiment of Applicant's snap assembly.

FIG. 8A shows snap button assemblies 22/24 engaged at one end to neck strap end 16/18 and at the other end with a spring clip 42 to the workpiece itself.

Figure 9:
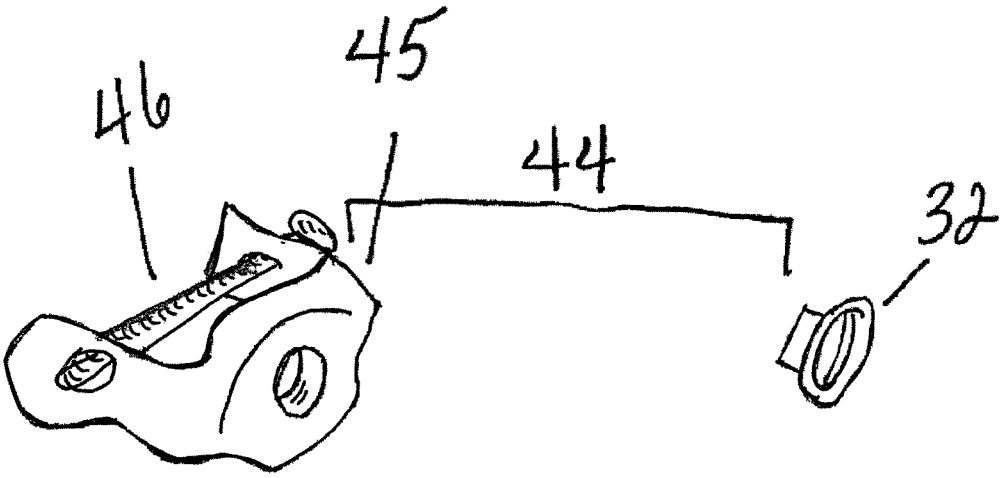
Figure 10:
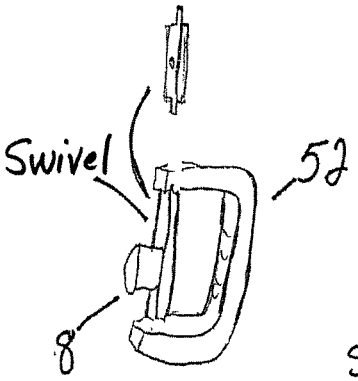
Figure 11:
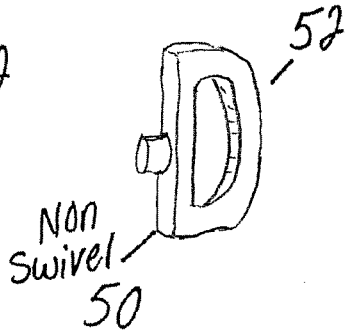

FIG. 9 illustrates another view of means 60, here the modified loops or rings of FIG. 8. In FIGS. 9, 15, and 16, a U-shaped member is seen with a base 45 with arms extending generally either perpendicular outward or perpendicular and then back from the rotation plane, which arms may be adapted to receive an axle 46 around which the neck strap 14 may be engaged. FIG. 16 shows the manner in which tension in neck strap 14 will provide axial separation when the male and female portions are configured perpendicular thereto, such as in the pair of U-shaped members illustrated therein.

Figure 12:
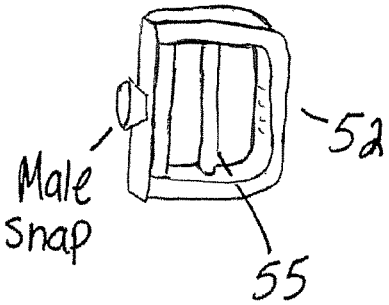
Figures 13, 14:
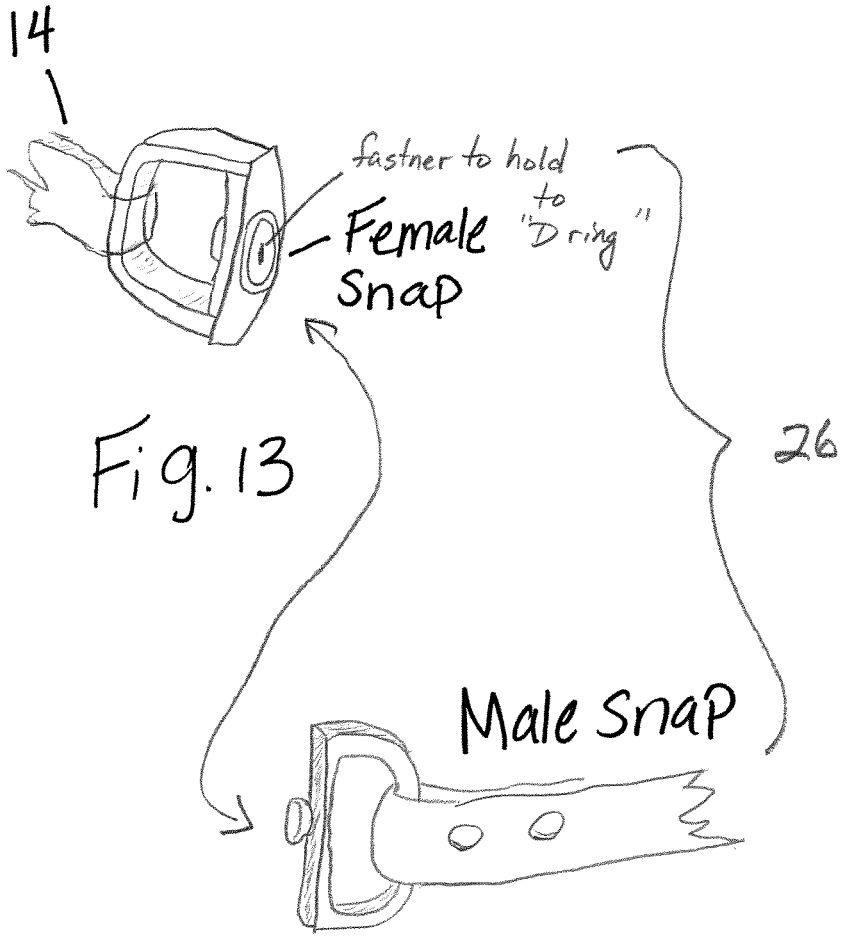

FIGS. 10, 11, 12, and 13 all illustrate a D-ring with a swivel 48 or non-swivel 50 straight member. Typically, the swivel 48 or non-swivel 50 arm may have separated and spaced apart therefrom, a cross-arm or transverse bar 52 that is adapted to receive a strap portion 14 as best seen in FIG. 13. FIG. 17 shows the snap button assembly with strap segments 15*a*/15*b* directly engaging the strap, as in some of the earlier embodiments, see FIGS. 1-5. FIG. 7 is a "hybrid" with fabric directly engaging the male portion and workpiece or neck piece attachment means on the female portion. FIGS. 8-16 are all embodiments that use intervening structure between the male or female portion and the strap portion or workpiece. In the other Figures showing intervening structure, swivel or non-swivel arms are used to mount the snap buttons thereto and then spaced back arms with cross-members for engaging the fabric strap are shown. FIG. 12 shows a neck strap adjustment bar 55, so that a strap may be configured around bar 55 and cross-member 52 to adjustably set the position of the strap engaging male portion illustrated in FIG. 12.

Applicant also discloses a kit for existing neck straps. A kit can be made to modify existing neck straps. The breakaway snap button feature can be attached to a mask, for example, and breakaway feature can be added to existing mask strap (correspondingly) to turn a non-breakaway strap (existing) into, now, a breakaway strap and is also part of this application disclosure. A kit may include snap assemblies and any of the means 60, such as loops, D-rings or U-shaped members, with or without snap clips.

Even though a neck strap is what is focused on, the breakaway snap button can be used in other instances where, for safety purposes, a linear snap button safety breakaway assembly would work, be desired or preferred to prevent injury, for instance. on a baby bib to prevent choking or hanging, or a preventable injury. A linear pull safety breakaway using baby sized snap buttons is preferred or appropriate sized snap buttons. For an apron with a neck strap in the workplace, a linear pull safety breakaway would be preferred. The focus is: safety, a true linear pull safety breakaway using snap buttons which allow rotatability and releasability for safety.

Other embodiments are anticipated, including apparel, clothing, baby bib or on a full workplace apron which has a releasable neck strap like a chef cooking apron or any other type of apron in the workplace that has a neck strap portion.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. An assembly for releasably retaining a workpiece to a person's body comprising:

a lanyard or neck strap having a first and a second end, the ends engaging the workpiece, and a body portion between the two ends of the strap, the strap including:

a first snap button assembly comprising a circular male portion and a circular female portion and a second snap button assembly comprising a circular female portion and a circular male portion, the two portions of each assembly lay in a common plane when releasably joined and are rotatable, one with respect to the other, about a common axis of rotation; and means for engaging one of the male portions or the female portions of at least one of the two snap button assemblies to the workpiece to translate tension in the neck strap to a separation force that is along the same axis as the axis of rotation.

2. The assembly of claim 1, wherein the means for engaging is a D-ring with a curved portion and a straight member, the straight member attached to the female or the male portion, or each portion, of the snap button assembly.

3. The assembly of claim 2, further including a snap clip for engaging the D-ring to the workpiece.

4. The assembly of claim 2, wherein the straight member is pivotally attached to the ends of the curved portion of the D-ring.

5. The assembly of claim 2, wherein the D-ring further includes a transverse bar for receiving a portion of the strap.

6. The assembly of claim 5, wherein the legs of the U-shaped member engage the body of the strap and the base engages one or both of the male/female portions.

7. The assembly of claim 1, wherein the workpiece is a firefighter's mask.

8. The assembly of claim 1, wherein the workpiece is a tool.

9. The assembly of claim 1, wherein the workpiece is a card.

10. An assembly for releasably retaining a workpiece to a person's body comprising:

a lanyard or neck strap having a first and a second end, the ends engaging the workpiece, and a body portion between the two ends of the strap, the strap including:

a first snap button assembly comprising a circular male portion and a circular female portion and a second snap button assembly comprising a circular female portion and a circular male portion, the two portions of each assembly lay in a common plane when releasably joined and are rotatable, one with respect to the other, about a common axis of rotation; and means for engaging one of the male portions or the female portions of at least one of the two snap button assemblies to the workpiece to translate tension in the neck strap to a separation force that is along the same axis as the axis of rotation;

wherein the means for engaging includes a rigid U-shaped member having legs and a base;

wherein the legs of the U-shaped member engage the body of the strap and the base engages one of the male/female portions.

11. The assembly of claim 10, wherein the legs of the U-shaped member include a cross-bar therebetween for engagement with the strap.

12. An assembly for releasably retaining a workpiece to a person's body comprising:

a lanyard or neck strap having a first and a second end, the ends engaging the workpiece, and a body portion between the two ends of the strap, the strap including:

a first snap button assembly comprising a circular male portion and a circular female portion and a second snap button assembly comprising a circular female portion and a circular male portion, wherein the two portions of each assembly lay in a common plane when releasably joined and are rotatable, one with respect to the other, about a common axis of rotation; and means for engaging one of the male portions or the female portions of at least one of the two snap button assemblies to the workpiece to translate tension in the neck strap to a separation force that is along the same axis as the axis of rotation wherein the means for engaging comprises on one or both of the male and female portions, a pair of short strap sections forming a V-shape, with the mouth of the "V" spanning the male and/or female portion, and the apex of the "V" joining the strap or the workpiece.

13. The assembly of claim 12, further including a spring clip.

14. The assembly of claim 12, wherein the workpiece is a firefighter's mask.

15. The assembly of claim 12, wherein the workpiece is a tool.

16. The assembly of claim 12, wherein the workpiece is a card.

17. An assembly for releasably retaining a workpiece to a person's body comprising:

a lanyard or neck strap having a first and a second end, the ends engaging the workpiece, and a body portion between the two ends of the strap, the strap including:

a first snap button assembly comprising a circular male portion and a circular female portion and a second snap button assembly comprising a circular female portion and a circular male portion, the two portions of each assembly lay in a common plane when releasably joined and are rotatable, one with respect to the other, about a common axis of rotation; and means for engaging one of the male portions or the female portions of at least one of the two snap button assemblies to the workpiece to translate tension in the neck strap to a separation force that is along the same axis as the axis of rotation; wherein the means for engaging includes a rigid "u" shaped member.

18. The assembly of claim 17, further including a spring clip.

19. The assembly of claim 17, wherein the workpiece is a firefighter's mask.

20. The assembly of claim 17, wherein the workpiece is a tool.

21. The assembly of claim 17, wherein the workpiece is a card.

* * * * *